US006435444B1

(12) United States Patent
Lin

(10) Patent No.: US 6,435,444 B1
(45) Date of Patent: Aug. 20, 2002

(54) REEL FOR A SUSPENDED SUNSHADE

(76) Inventor: Steve Lin, No. 80, Kengtsai Ping, Hoping Village, Chuchi Hsiang, Chiayi Hsien (TW)

( * ) Notice: Subject to any disclaimer, the term of this patent is extended or adjusted under 35 U.S.C. 154(b) by 0 days.

(21) Appl. No.: 09/759,705

(22) Filed: Jan. 12, 2001

(51) Int. Cl.[7] ..... A45B 17/00; B65H 75/30
(52) U.S. Cl. ..... 242/396.6; 242/395; 135/20.3
(58) Field of Search ..... 242/396.6, 396.5, 242/396, 422.4, 395, 395.1; 135/20.3, 25.1, 25.4, 25.41

(56) References Cited

U.S. PATENT DOCUMENTS

| | | | | | |
|---|---|---|---|---|---|
| 726,449 | A | * | 4/1903 | McKee | 242/395 |
| 860,304 | A | * | 7/1907 | Keuffel | 242/395 |
| 874,130 | A | * | 12/1907 | Stanley | 242/395.1 |
| 1,991,263 | A | * | 2/1935 | Stewart | 242/395.1 |
| 3,437,281 | A | * | 4/1969 | Quenot | 242/396.6 |
| 4,522,349 | A | * | 6/1985 | Clerk | 242/395 |
| 4,674,522 | A | * | 6/1987 | Ma | 135/20.3 |
| 4,938,430 | A | * | 7/1990 | Chapin | 242/396.6 |
| 5,844,859 | A | * | 12/1998 | Iwamoto et al. | 365/230.03 |
| 6,152,156 | A | * | 11/2000 | Tung | 135/20.1 |

FOREIGN PATENT DOCUMENTS

| | | | |
|---|---|---|---|
| JP | 6-206671 | * | 7/1994 |

* cited by examiner

*Primary Examiner*—William A. Rivera
(74) *Attorney, Agent, or Firm*—Kolisch Hartwell Dickinson McCormack & Heuser

(57) ABSTRACT

A reel has a housing, an axle, a handle, a wheel and a friction element. The friction element is mounted in the housing and presses against the wheel. The friction element is made of an elastic material. The friction element includes an inverse U-shaped base and a protruding contact pad extending up from the base portion to press against the outer edge of the wheel. Consequently, the wheel can be stopped in any desired position by the friction element, and the degree to which the canopy can be expanded is controlled. The use of the suspended sunshade becomes more versatile.

2 Claims, 5 Drawing Sheets

REEL FOR A SUSPENDED SUNSHADE

BACKGROUND OF THE INVENTION

1. Field of the Invention

The present invention relates to a reel, and more particularly to a reel for a suspended sunshade, which has a friction element to stop the reel.

2. Description of Related Art

A conventional sunshade comprises a base, a post, a frame and a canopy. The post extends upward from the base. The frame is foldable and mounted on the top of the post. The canopy is attached to the frame to cover the frame. When the frame is expanded, the canopy is simultaneously expanded to shade the sunlight. However, because the canopy is arranged above the base, the space under the canopy for the user to use is reduced because the base is in the shaded area. Therefore, a suspended sunshade as shown in FIGS. 3 and 4 is provided to increase the useable space.

The conventional suspended sunshade comprises a base (40), a post (41), a suspending rod (44), a tube (45), a frame (47), a canopy (46) and a reel (50). The post (41) extends upward from the base (40). The suspending rod (44) is pivotally connected to the top of the post (41). A sleeve (42) is slidably mounted on the post (41). A lever (43) is pivotally connected between the sleeve (42) and one end of the suspending rod (44). The tube (47) extends downward from the other end of the suspending rod (44). The frame (47) is moveably and foldably attached to the tube (45). The canopy (46) is attached to the frame (47) to cover the frame (47). The reel (50) is mounted on the opposite end of the suspending rod (44) from the tube (45). A cord (48) is connected between the reel (50) and the frame (47) and extends through the suspending rod (44) and tube (45).

With reference to FIGS. 4 and 5, the conventional reel (50) for the suspended sunshade comprises a housing (52), an axle (54) and a wheel (58). The housing (52) is attached to the end of the suspending rod (44). The axle (54) is rotatably mounted in the housing (52) and extends out from the housing (52). A handle (56) is secured to the exposed end of the axle (54). The wheel (58) is secured to the axle (54) and rotatably mounted in the housing (52). One end of the cord (48) is securely connected to the wheel (58). When the user rotates the handle (56), the axle (54) and the wheel (58) will rotate with the handle (56). The cord (48) will be wound around the wheel (58) or unwound from the wheel (58). This causes the frame (47) to move relative to the tube (45) through the cord (48), and the frame (47), and the canopy (46) will be folded or expanded. In addition, a stop is arranged between the tube (45) and the frame (47), such that the frame (47) and the canopy (46) are held in the expanded position by the stop. Because the base (40) and the post (41) are not under the canopy (46), the useable shaded space under the canopy (46) is increased.

However, because the conventional reel (50) does not have a friction element, the frame (47) and the canopy (46) can only be completely folded or fully expanded. The degree to which the canopy (46) is expanded is not controllable. The use of the suspended sunshade is limited.

To overcome the shortcomings, the present invention provides an improved reel for a suspended sunshade to mitigate or obviate the aforementioned problems.

SUMMARY OF THE INVENTION

The main objective of the invention is to provide an improved reel with a friction element to hold the wheel in any desired position so the degree to which the canopy of the suspended sunshade is expanded is controllable. The reel comprises a housing, an axle, a handle, a wheel and a friction element. The friction element is mounted in the housing and presses against the wheel. The friction element is made of an elastic material. The friction element includes an inverse U-shaped base portion and a protruding contact pad extending up from the base portion to press against the wheel. Consequently, the wheel can be stopped in any desired position by the friction element, and the degree to which the canopy is expanded is controlled. The use of the suspended sunshade becomes more versatile.

Other objects, advantages and novel features of the invention will become more apparent from the following detailed description when taken in conjunction with the accompanying drawings.

DETAILED DESCRIPTION OF PREFERRED EMBODIMENT

Figure 1:
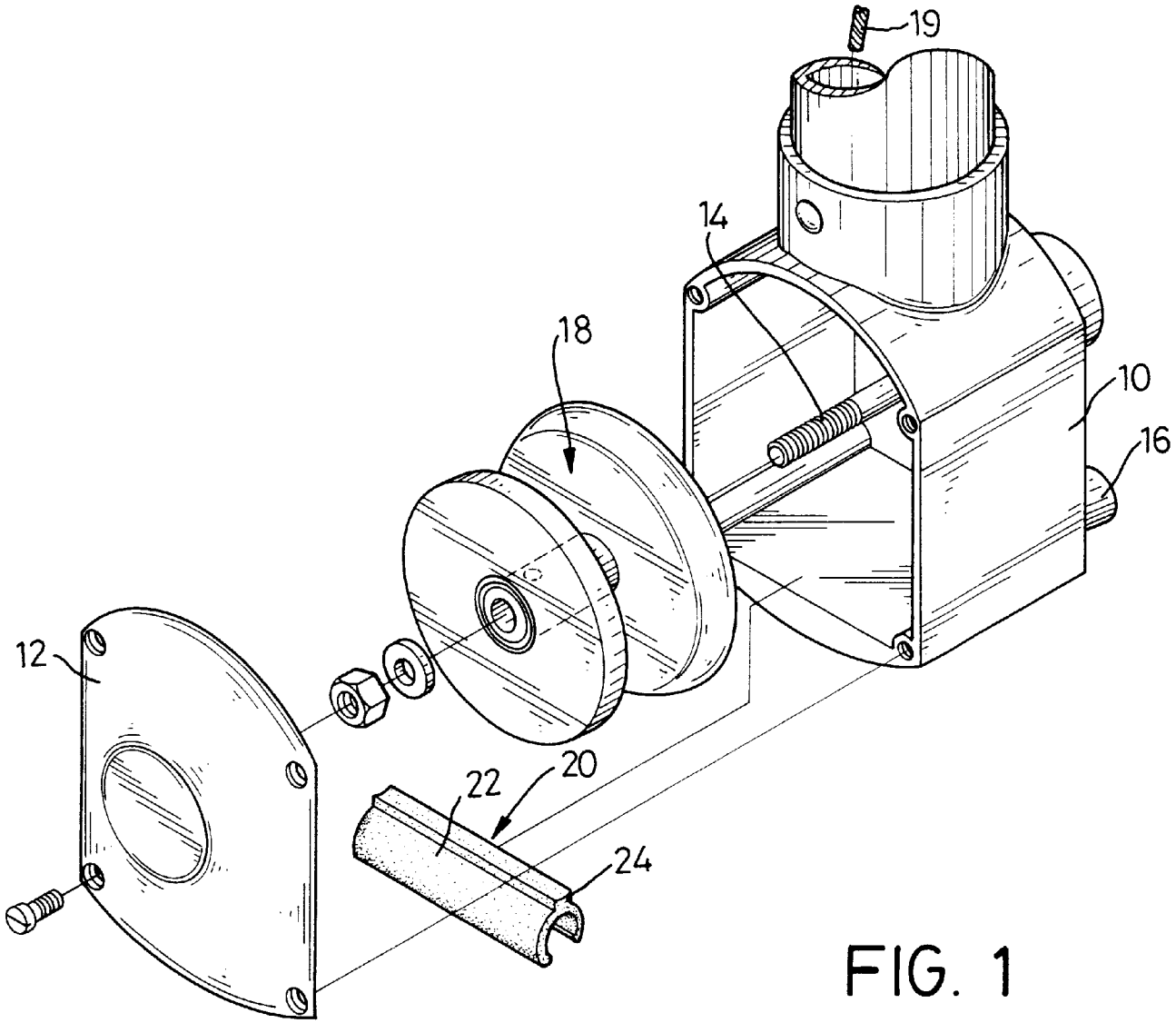
FIG. 1 is an exploded perspective of a reel in accordance with the present invention.
Figure 2:
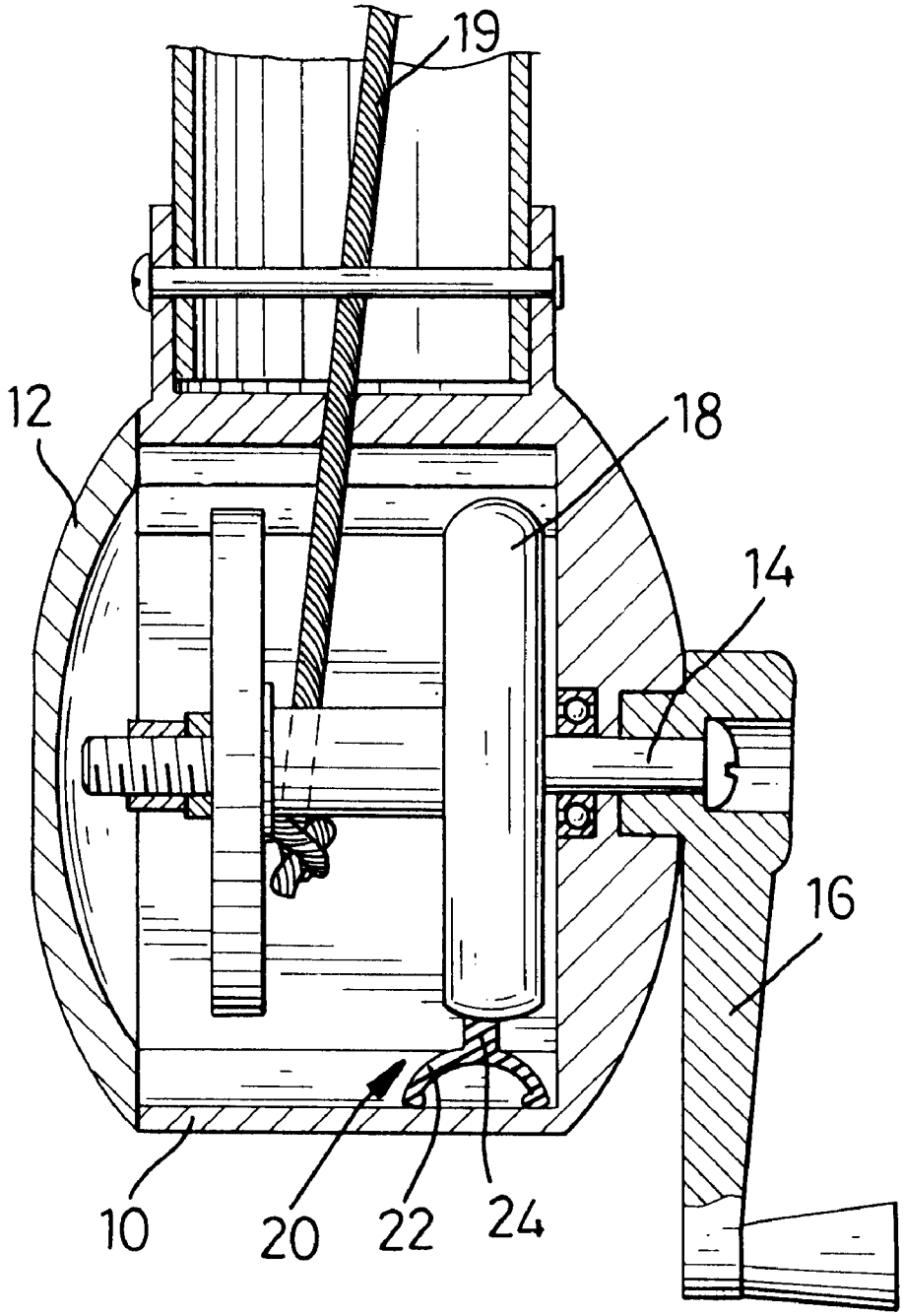
FIG. 2 is a front plan view in partial section of the reel in FIG. 1.
Figure 3:
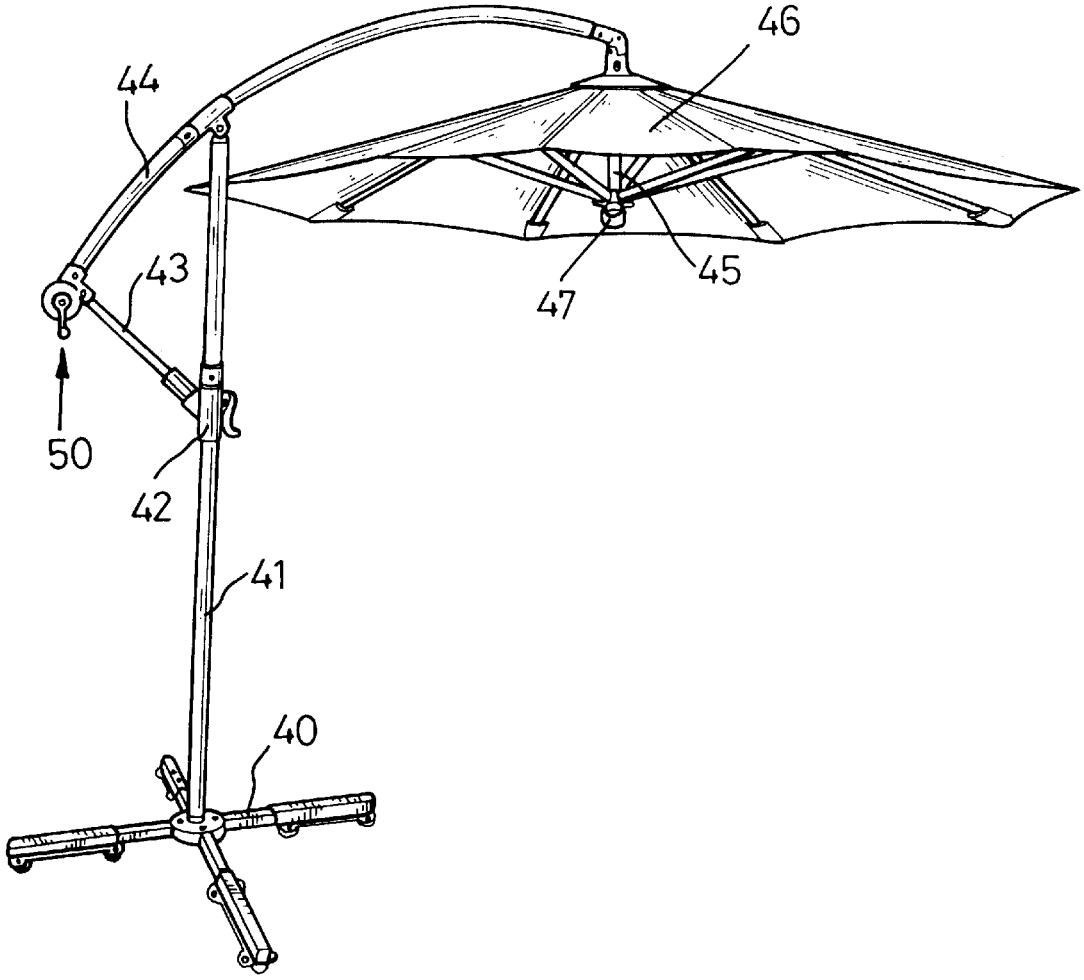
FIG. 3 PRIOR ART
FIG. 3 is a perspective view of a suspended sunshade with a conventional reel in accordance with the prior art.
Figure 4:
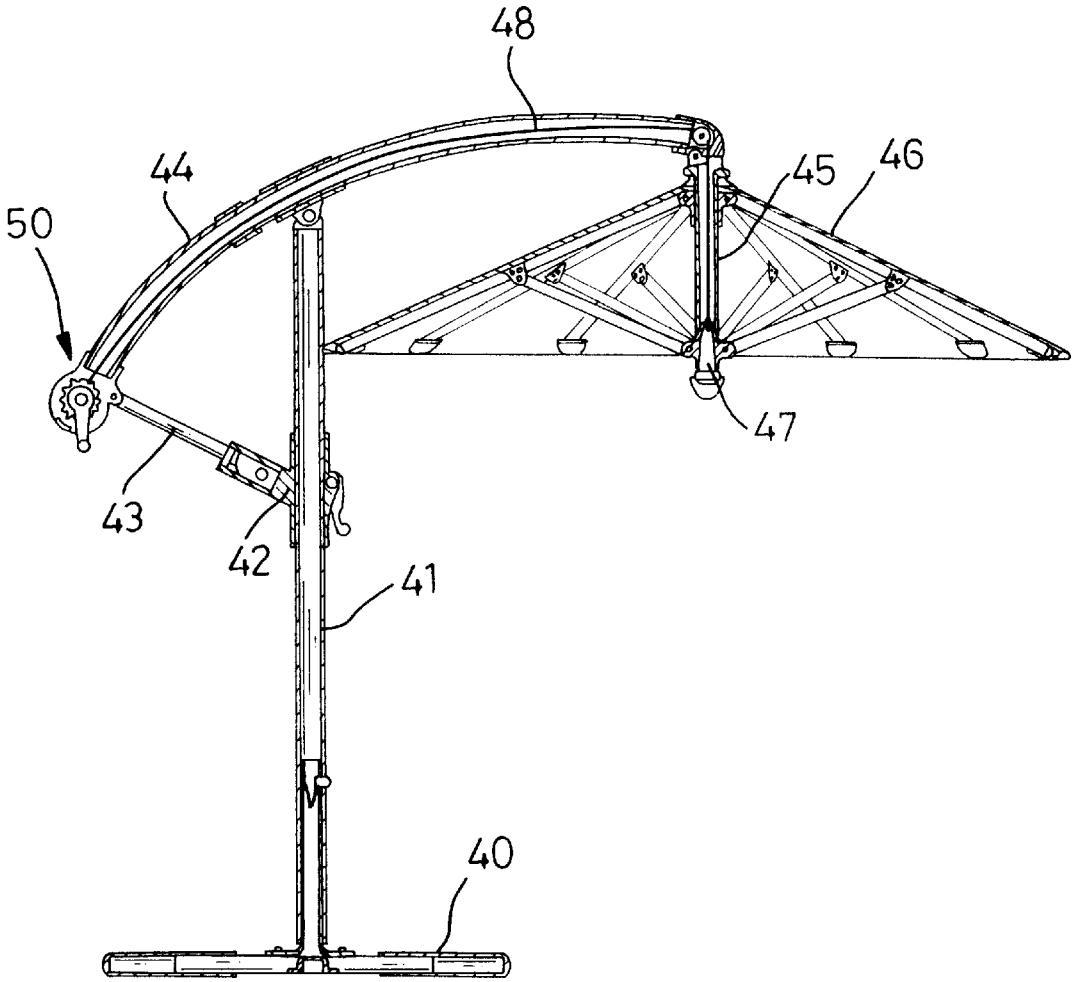
FIG. 4 PRIOR ART
FIG. 4 is a side plan view in partial section of the suspended sunshade in FIG. 3.
Figure 5:
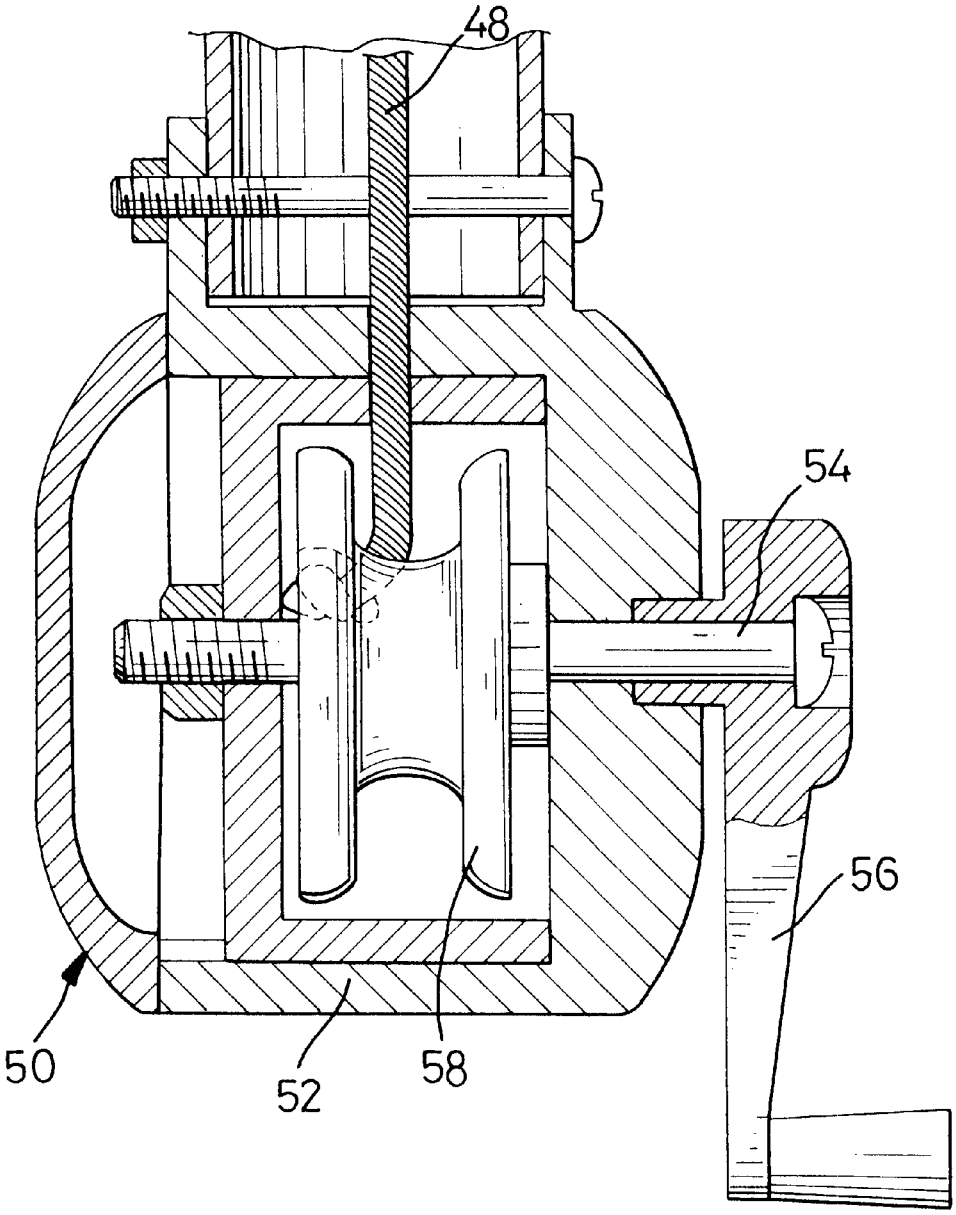
FIG. 5 PRIOR ART
FIG. 5 is a front plan view in partial section of the conventional reel in FIG. 3.

With reference to FIGS. 1 and 2, a reel in accordance with the present invention comprises a housing (10), an axle (14), a handle (16), a wheel (18) and a friction element (20). The housing (10) is securely connected to one end of the suspending rod of a suspended sunshade. The housing (10) has an opening, and a cover (12) is attached to the opening to close the housing (10). The axle (14) is rotatably mounted in the housing (10) and extends out from the housing (10). The handle (16) is securely attached to the exposed end of the axle (14). The wheel (18) is securely attached to the axle (14) inside the housing (10). One end of a cord (19) of the suspended sunshade extends into the housing (10) and is securely connected to the wheel (18). The friction element (20) is located in the housing (10) and presses against the outer edge of the wheel (18). The friction element (20) is made of an elastic material like rubber or silicon. The friction element (20) includes an inverse U-shaped base (22) and a protruding contact pad (24). The length of the base (22) is equal to the inner width of the housing (10). The protruding contact pad (24) extends up from the base (22) and has a length equal to that of the base (22). The height of the friction element (20) is larger than the width of the gap defined between the inner wall of the housing (10) and the outer edge of the wheel (18). Consequently, when the friction element (20) is mounted in the housing (10) between the inner wall of the housing (10) and the outer edge of the wheel (18), the inverse U-shaped base (22) will deform and be under a constant restoration force. The friction element (20) will be securely held in position, and the protruding contact pad (24) will tightly press against the outer edge of the wheel (18).

When the user rotates the handle (16), the axle (14) and the wheel (18) will rotate with the handle (16). The cord (19) will be wound around the wheel (18) or unwound from the wheel (18), and the canopy of the suspended sunshade will be folded or expanded. Because the friction element (20) is mounted in the housing (10) and abuts the wheel (18), the wheel (18) will stop rotating and be held in position by the friction element (20) when the user stops applying a rotational force to the handle (16). The wheel (18) can stop at any desired position, such that the canopy can be expanded to any desired degree. Consequently, the degree to which the canopy of the suspended sunshade can be expanded is controllable. The use of the suspended sunshade becomes more versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reel comprising:

a housing;

an axle rotatably mounted in the housing and having a first end exposed from the housing and a second end extending into the housing;

a handle securely attached to the first end of the axle;

a wheel securely attached to the second end of the axle; and a friction element located in the housing and pressing against an outer edge of the wheel;

wherein the friction element is made of an elastic material and includes an inverse U-shaped base and a protruding contact pad extending up from the base portion to press against an outer edge of the wheel.

2. The reel as claimed in claim 1, wherein the base has a length equal to an inner width of the housing;

the protruding contact pad has a length equal to the base; and the friction element has a height larger than the width of a gap defined between the inner wall of the housing and the outer edge of the wheel.

* * * * *